US005620299A

United States Patent [19]

Grabovsky et al.

[11] Patent Number: 5,620,299

[45] Date of Patent: Apr. 15, 1997

[54] PROCESS AND DEVICE TO STORE AND SEPERATE TEXTILE TUBES

[75] Inventors: Gerhard Grabovsky, Lenting; Bernhard Stang, Kipfenberg, both of Germany

[73] Assignee: Rieter Ingolstadt Spinnereimaschinenbau AG, Ingolstadt, Germany

[21] Appl. No.: 349,073

[22] Filed: Dec. 2, 1994

[30] Foreign Application Priority Data

Dec. 24, 1993 [DE] Germany ..... 43 44 548.9

[51] Int. Cl.[6] ..... B66F 11/00

[52] U.S. Cl. ..... 414/745.7; 198/433; 139/245; 139/251

[58] Field of Search ..... 198/443, 445, 198/433, 359; 414/745.7, 153; 57/270; 242/35.5 A; 139/245–246, 247, 251

[56] References Cited

U.S. PATENT DOCUMENTS

| | | | |
|---|---|---|---|
| 921,909 | 5/1909 | Stone | 139/246 |
| 1,122,417 | 12/1914 | Peterson | 57/270 |
| 1,321,275 | 11/1919 | Barrell | 139/246 |
| 2,921,610 | 1/1960 | Banks et al. | 139/245 |
| 4,066,218 | 1/1978 | Kamp . | |
| 4,125,990 | 11/1978 | Stahlecker et al. . | |
| 4,830,171 | 5/1989 | Kupper | 198/358 |
| 5,048,574 | 9/1991 | Rossie et al. . | |
| 5,078,565 | 1/1992 | Fritschi et al. | 242/35.5 A |

FOREIGN PATENT DOCUMENTS

| | | | |
|---|---|---|---|
| 615301 | 6/1935 | Germany . | |
| 1104410 | 4/1961 | Germany . | |
| 1553120 | 7/1970 | Germany . | |
| 6032731 | 11/1982 | Japan | 242/35.5 A |

*Primary Examiner*—Karen B. Merritt
*Assistant Examiner*—Douglas Hess
*Attorney, Agent, or Firm*—Dority & Manning

[57] ABSTRACT

The invention relates to a process and apparatus for the random storage of tubes stacked on top of each other in a tube magazine, and for the transfer of the tubes at a transfer position to a conveyor. The tubes are stored randomly in the magazine with their longitudinal axes essentially parallel to each other. Tubes are separated between the transfer position and the magazine and are conveyed out of the magazine in the axial direction.

19 Claims, 3 Drawing Sheets

PROCESS AND DEVICE TO STORE AND SEPERATE TEXTILE TUBES

BACKGROUND OF THE INVENTION

The present invention relates to a process and to a spinning plant machine with a device to store tubes stacked on top of each other in a magazine and to transfer the stored tubes at a transfer position to a conveyor.

A device of this type is known from DE 39 12 026 A1. Here bobbin tubes are stored on top of each other. The lowest layer of the bobbin tubes is lying on a conveyor belt, the conveying direction of which is substantially perpendicular to the axis of the bobbin tubes. The conveyor belt exerts a force on the bobbin tubes in the direction of the transfer position where a conveyor takes over the tubes. In this design, it is a disadvantage that when different frictional values occur between the tubes and the conveyor belt, secure conveying of the tubes from the magazine is not assured in many instances.

Also known through DE-OS 25 06 362 is the storing of the tubes in a magazine in such manner that they are stacked directly on top of each other. Conveyor chains which transfer the bobbin tubes to a grasper are provided at the bottom of the magazine. Catches are provided on the conveyor chains which grasp the tubes from the magazine. The catches subdivide the conveyor chain into individual compartments. Also, the magazine is subdivided into several adjoining shafts in which the tubes are placed with their axes perpendicular to the conveying direction of the conveyor chain.

It is a disadvantage in this design that the pre-sorted tubes, stacked on top of each other, require much more volume for the storage of the same amount of tubes than with a chaotic storage according to DE 39 12 026 A1. Furthermore, the filling of the magazine is time consuming because the tubes must be placed in the shafts of the magazine in a sorted state.

OBJECTS AND SUMMARY OF THE INVENTION

It is a principal object of the instant invention to create a process and a device in which the tubes can be conveyed to a transfer position with the least possible space requirement in the magazine. The removal of the tubes from the magazine is to be rapid and secure and must eliminate the disadvantages of the state of the art. Additional objects and advantages of the invention will be set forth in part in the following description, or may be obvious from the description, or may be learned through practice of the invention.

The objects are attained through the characteristics of the invention. In the state of the art, it is a further disadvantage that the tubes above the tubes to be taken out must always be lifted up so that the wanted tubes may be conveyed to the transfer position, perpendicularly to their axis.

According to the invention, the tubes are stored randomly on top and next to each other in the magazine, but with their axes essentially parallel to each other. The tubes are separated below the magazine and are then removed in the axial direction from the magazine. The described disadvantages of the state of the art are thus avoided. The tubes to be removed need not lift the tubes stored above them to be removed from the magazine. The tubes are stacked in the magazine by the operator for storage in the magazine, without the requirement that the tubes must be mounted or inserted on or into certain devices. The sorting or separation of the tubes takes place automatically below the magazine so that the operators expend no effort in sorting. When the tubes are removed from the magazine in the axial direction after sorting, the tubes are handled with care and the removal is more reliable than in the state of the art.

Several tubes in a row are advantageously separated next to each other. This ensures a rapid and secure removal of tubes, since even in case that a space remains free for separated tubes, at least one tube is nevertheless ready for removal. If the row of separated tubes is taken out simultaneously, the removal safety is again improved. If the tubes are pushed on a conveyor according to an advantageous design, conveying away of the tubes is ensured without delay or additional effort.

After a removal of the tubes, the conveyor is clocked ahead in one or several steps until free tube positions of the conveyor are in position before the transfer position.

The separation or pre-sorting of the tubes is advantageously carried out in that the tubes which are in random order relative to the take-out device are guided into compartments. This can be carried out by means of gravity or, for upward removal, by means of a spring force for example, which acts from below towards the top upon the tubes. It has proven to be especially advantageous to move the compartments in order to avoid the formation of tube bridges which would prevent a further conveying of the tubes to the sorting device. Bridges are thus always broken up so that the tubes are again conveyed to the sorting device.

Secure removal of the tubes is ensured if the tubes which continue to remain in the magazine or in the sorting device are prevented to slide and follow as tubes are being taken out.

In a spinning plant machine according to the invention, stationary compartments located between the magazine and the transfer position are provided to separate the tubes. The tubes which are stacked on top of each other chaotically but with their axes parallel to each other drop gradually into the compartments and are ready to be taken out. If the sides of the compartments are made in the form of movable rockers, this reliably results in breaking up any formations of tube bridges which would prevent further conveying of tubes to the transfer position. This is effected in an especially reliable manner due to the fact that the rockers can be moved back and forth. The rockers therefore constantly brush against the tubes and move them so that bridges are broken up. The back-and-forth movement is executed advantageously around a pivot point which is located as close as possible to the transfer position. Reliable conveying of the tubes to the transfer position is thereby ensured independently of the position of the rockers.

If the compartments are made so high that at least two tubes are placed on top of each other, the probability that at least one tube is present in a compartment is increased, since more time remains for pre-sorting thanks to the back-and-forth movement of the rockers.

An arrangement by which the magazine with the stored tubes is placed in a first plane and the conveyor in a second plane has proven to be especially advantageous and of simple construction. The removal of the tubes from the magazine is thereby rendered possible by means of a simple movement which is axial relative to the tubes. The device is especially space-saving if the first and second planes are essentially parallel to each other.

If the tubes are moved in the axial direction from the transfer position by means of a slider, the device can be designed simply and at a low cost. A design with this configuration furthermore renders it very reliable in operation. The slider is preferably located underneath the compartments so that the tubes are fed directly from the compartments when the rocker is in a ready-for-reception position. If a support is provided on the rocker to support the tubes which are present in the compartments, tubes which are still in the compartments or in the magazine are prevented from sliding and following. This also results in a reliable operation of the device.

In order to ensure problem-free further conveying and possible subsequent removal of the tubes from the conveyor, the conveyor is made up of a chain with tube holders. In an advantageous embodiment the tubes are pushed on these tube holders by means of the slider. To prevent the tubes from slipping off the tube holder due to machine vibrations, the tubes are clamped radially. In another embodiment, a tube guide between the conveyor and the tubes prevents the tubes from sliding off.

An additional separating device is advantageously provided between the compartments and the transfer position. This ensures that the slider pushes out only the lowest tube and not the tube located above it, especially when the tube diameters are small. The separating device is designed so that the distance between its holders can be changed. By changing the distance between holders, the lowest tube is released so as to fall into a compartment of the slider while the tubes located above it are held back.

An example of an embodiment of the invention is described in the following figures.

DETAILED DESCRIPTION OF THE PREFERRED EMBODIMENTS

Reference will now be made in detail to the presently preferred embodiments of the invention, one or more examples of which are illustrated in the accompanying drawings. Each example is provided by way of explanation of the invention, and not as a limitation of the invention. In fact, it will be apparent to those skilled in the art that various modifications and variations can be made in the invention without departing from the scope and spirit of the invention. Additionally, the numbering of components is consistent throughout the application, with the same components having the same numbers.

Figure 1:
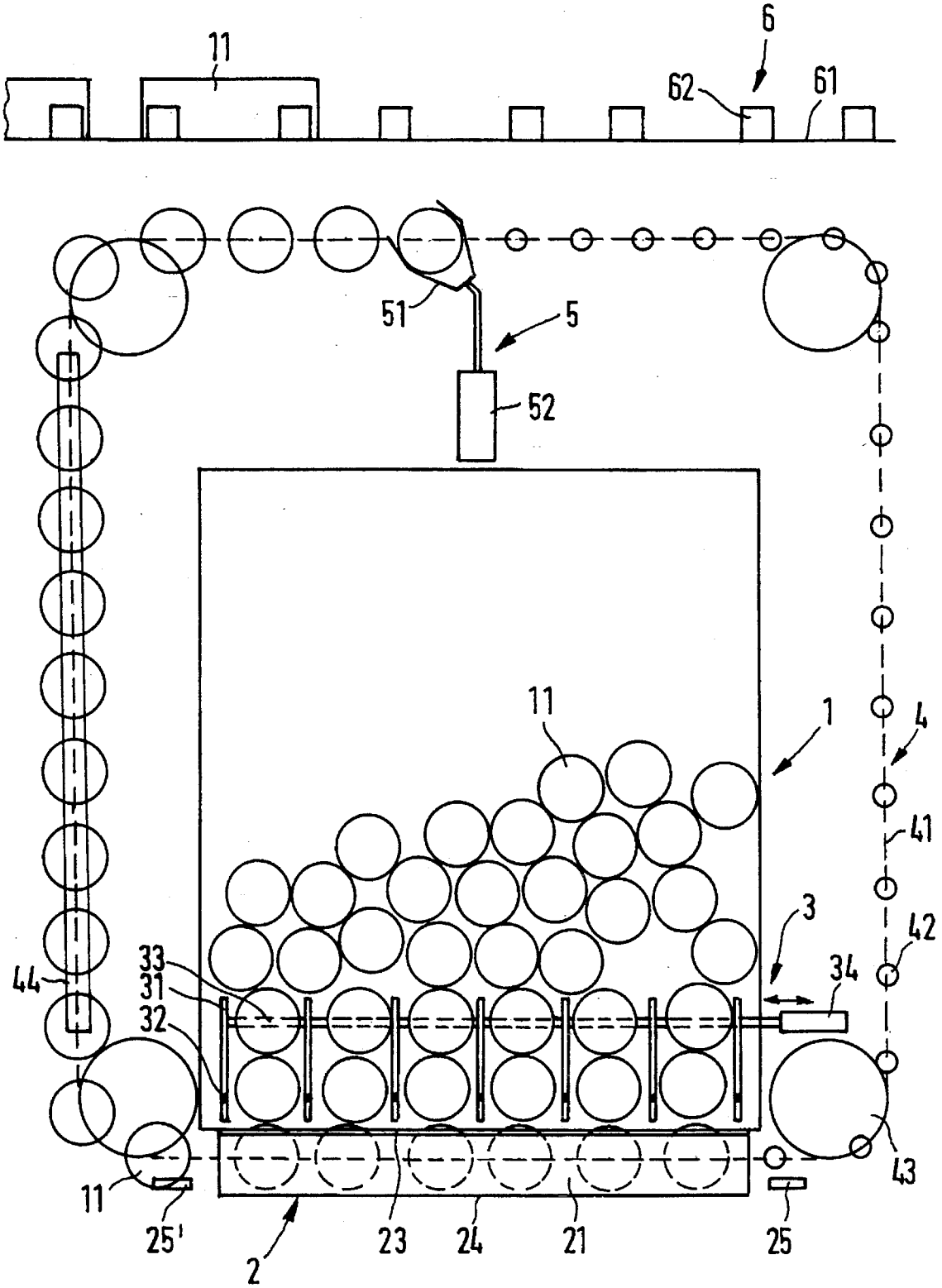
FIG. 1 shows a front view of a tube magazine.

FIG. 1 shows a front view of the device according to the invention. The device consists of a magazine 1 and a transfer position 2. Compartments 3 for the pre-sorting of tubes 11 are located between the magazine 1 and the transfer position 2. In this embodiment, the tubes 11 are located in the magazine 1 above the compartments 3 in a random state but with their axes parallel. To fill tubes 11, operators take the tubes 11 from a crate (not shown) and place the tubes 11 in the magazine 1. The device is then able to operate automatically and without operator action over a longer period of time. The operator action can also be very brief, as contrary to the state of the art, the tubes need not be sorted or placed on tube holders. The tubes 11 gradually drop into the compartments 3 and are thus conveyed to the transfer position 2. The compartments 3 have sides made in the form of rockers 31. The rockers 31 are triggered by means of a pneumatic cylinder 34 via a rod 33. Each rocker rotates around a swivelling axis 32. The top of the rocker 31 thus pushes against the tube 11 still in the magazine 1 and thus breaks up any possible bridge formation. The tubes 11 thus loosened up are then able to drop into the compartments 3.

The tubes 11 drop through the compartments 3 onto a slider 21. The slider 21 can be designed so as to be provided with a seat, e.g. in the form of guides 24, for each separate tube. This seat may be in form of a trough in which the tube 11 comes to lie. But it may suffice, as shown in the shown embodiment, if the rockers 31 extend to within close proximity of the slider 21 so that the rockers 31 ensure lateral guidance of the tubes 11 even when they are deposited on the slider 21. This prevents undoing the sorting of the tubes 11 on the slider 21. However the rockers 31 do not prevent the movement of the slider 21.

A support is provided advantageously at the top of the slider 21 preventing the tubes 11 present in the compartments 3 from dropping for as long as the slider 21 is not in a receiving-ready position. The tubes 11 readied in the slider 21 are pushed by the pushing movement of the slider 21 onto holders 42 of a conveyor 4. The holders 42 are installed on a chain 41 and put in place in receiving-ready position in front of the slider 21. The chain 41 is taken past the transfer position 2 by means of deflection pulleys 43 in this embodiment and conveys the tubes 11 from the transfer position 2 to a transfer device 5. To prevent the tubes from sliding off their holders 42 as a result of possible machine vibrations, a tube guide 44 is provided to secure the tubes 11 on the holders 42 in areas where no removal of tubes is to take place. In order to avoid operating errors, a light barrier 25, 25' is provided to check whether any tubes 11 are present in the area of the holders 42 which are in front of the slider 21. As long as this is the case, no new tubes 11 may be pushed on the holders 42. Only when the entire area in front of the slider 21 is free of tubes 11 can the slider 21 be actuated.

The conveyor 4 conveys the tubes 11 from the transfer position 2 to the transfer device 5. At the transfer device 5, a grasper 51, provided with a pneumatic drive 52 for example, is provided to take the tubes 11 from the conveyor 4 in this embodiment and transfers them to a belt conveyor 61 of a tube supply 6. The conveyor belt 61 is provided with a plurality of tube holders 62 into which the tubes 11 are inserted. The tube supply 6 is provided for the conveying of the tubes 11 to the individual work stations of a spinning plant machine 7. It is however also possible to provide for the conveyor 4 to convey the tubes 11 directly to the work stations of the spinning plant machine 7, whereby a dedicated belt conveyor 61 for the tube supply as well as the transfer device 5 can be avoided. In the embodiment of the illustrated example, the conveyor 4 conveys one tube 11 at a time into the range of grasper 51 so that the grasper 51 is able to transfer tube 11. As soon as the conveyor 4 has been shifted in this manner by as many holders 42 as can be fed at one time by the slider 21, the slider 21 is released for new feeding of the conveyor 4 with tubes 11.

Figure 2:
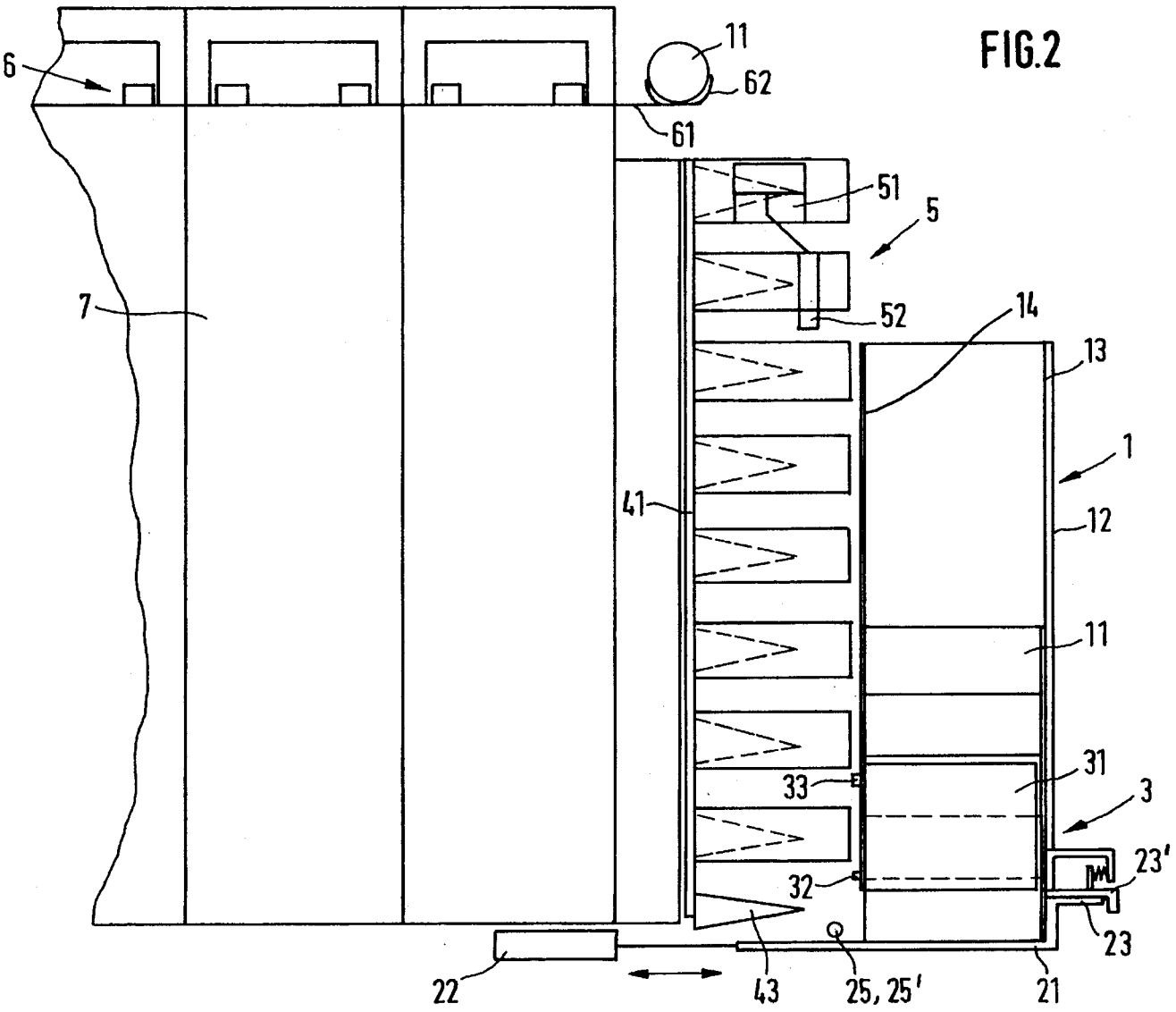
FIG. 2 shows a side view of a spinning plant machine with the tube magazine according to the invention.

FIG. 2 shows a lateral view of the spinning plant machine 7 according to the invention, together with the magazine 1. The magazine 1 is located in a plane in front of the conveyor 4. This greatly facilitates the filling of the magazine 1 as it is easily accessible to the operating personnel. The tubes make contact with the back of a rear wall 14. To ensure that the tubes 11 do not fall out of the magazine 1, said magazine 1 is closed by a door 12. The door 12 is advantageously provided with openings or is covered by a transparent disk 13 so that the current fullness state of the magazine 1 can be quickly ascertained by the personnel. The fullness state of the magazine 1 can also be ascertained by means of light barriers not shown here which scan different filling levels and may be transmitted to a machine center for example, or to a command post of the operating personnel.

The tubes 11 of the magazine 1 drop into the compartments 3 which are separated by rockers 31. The rockers 31 can be moved by rod 33 via swivelling axis 32 as described earlier in FIG. 1. Thereby, the formation of bridges of the tubes 11 and a damming up of these tubes 11 is avoided. The rockers 31 are designed so that they extend into the range of the slider 21. The height of the slider 21 is slightly less than the diameter of the tubes 11, so that the rocker 31 produces a lateral guidance of the tubes 11. A support 23 is provided on the slider 21 so that the tubes 11 are prevented from falling down for as long as the slider 21 is not again in a receiving-ready position following the ejection of the tubes 11. The tubes 11 are pushed out by a movement of the slider 21 which my be driven by a pneumatic cylinder 22.

In the shown embodiment the movement of the slider 21 actuates another support 23 by means of which a dropping of the tubes 11 on one side is reliably avoided. The support 23 is held in closed position by means of spring force. As soon as the slide 21 moves into the open position, the support 23' is also opened by the support 23.

The light barrier 25, 25' is provided so as to make it impossible for the tubes 11 to be pushed on the holders 42 of the conveyor 4 for as long as tubes 11 are on the holders 43 in the area of the slider 21. The light barrier 25, 25' signals to the control system whether the pushing process may be carried out. The tubes 11 placed on the conveyor 4 are conveyed into range of the grasper 51 of the transfer device 5 and are transferred to the tube supply 6. The tube supply 6 brings the tubes 11 to the appropriate work stations of the spinning plant machine 7.

Figure 3:
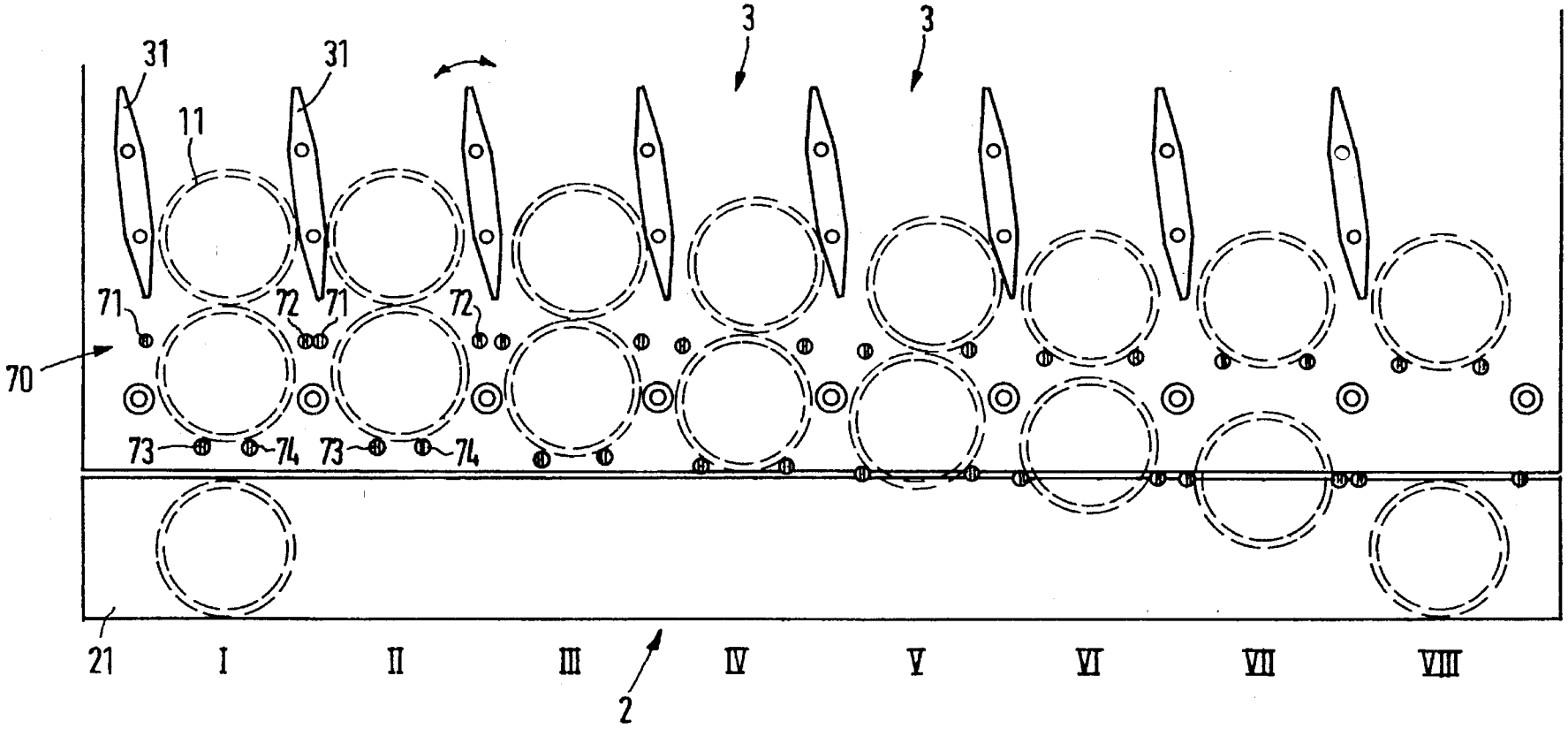
FIG. 3 shows a front view of the separating device.

FIG. 3 shows a separating device 70 which is located between the rockers 31 and the transfer position 2. While the rockers 31 produce a loosening and separation of the tubes 11 in the horizontal direction through their back-and-forth movement, the separating device 70 causes a separation of the tubes 11 in vertical direction. FIG. 3 shows the eight phases of separation by the separating device 70. The separating device 70 consists of the holders 71, 72, 73 and 74. The holders 71 and 72 and the holders 73 and 74 are respectively moved towards or away from each other. In phase I a separated tube 11 is present in the slide 21. The tubes 11 above it are held back by the holders 73 and 74. The holders 71 and 72 are at the greatest distance from each other so that they do not hinder the tubes 11. In phases II to V the holders 73 and 74 are gradually moved apart while the holders 71 and 72 move towards each other. In phase VI the respective distance are such that the upper tube 11 is held by the holders 71 and 72 and the lower tube 11 is gradually lowered through the widening distance between holders 73 and 74. In phase VII the distance between the holders 73 and 74 is such that the lower tube 11 drops through while the upper tube 11 is prevented from further movement by the holders 71 and 72. In phase VIII the lowest tube 11 has finally dropped into the slider 21 and is ready for the removal process, similarly to phase I. When the holders 71 and 72 are again moved apart and the holders 73 and 74 are moved together, the tube which is on top in phase VIII drops down by one plane while an additional tube 11 slides and follows from the magazine. In this way the state of phase I is achieved again. If several tubes are taken from the tube magazine in accordance with the examples of the embodiments of FIGS. 1 and 2, several holders 71 to 74 are assigned next to each other to the different compartments 3. All holders 71, 72, 73 or 74 are then connected by a rod (not shown) and are moved simultaneously. The rods are driven by a motor or a pneumatic cylinder. In order to obtain additional loosening of the tubes it is advantageous for the holders 71 to 74 to be moved not only horizontally in their movement but also slightly vertically.

The invention is not limited to the shown embodiments. It is also possible for the conveyor 4 to consist of a conveyor belt with cups to receive the tubes. It is equally possible to design the holders 42 so that the tubes are not clamped but are only carried. This has advantages when using the device for different tube diameters. In that case, the same holders can be used independently of the tube form. The magazine 1 can also be located in the same plane as the conveyor 4. In that case the slider 21 is designed so that it pushes the tubes out of the magazine, so that the tubes drop into an additional compartment and are then pushed back on the holder 42. It is also possible to locate the magazine 1 in two planes, i.e. in the plane shown in FIGS. 1 and 2 and in addition in the plane of the conveyor 4. When the tubes of the first plane have been used up, a pushing device can move the tubes of the second plane into the first plane so that they are conveyed in the plane from which the tubes can be removed.

It will be apparent to those skilled in the art that various modifications and variations can be made in the present invention without departing from the scope and spirit of the invention. For example, features illustrated or described as part of one embodiment can be used in another embodiment to yield a still further embodiment. It is intended that the present invention cover such modifications and variations as come within the scope of the appended claims and their equivalents.

We claim:

1. A process for storing and transferring tubes at a textile machine, said process comprising randomly loading the tubes in a storage magazine with their axis being essentially parallel so that the tubes settle in a random undefined order within the storage magazine; moving the randomly loaded tubes towards a position for transfer from the storage magazine; separating the randomly loaded tubes into ordered pre-determined positions prior to transferring the tubes; transferring the tubes at the transfer position from their ordered positions to a conveyor device; and said transferring to a conveyor device further comprising conveying the tubes in a direction away from the storage magazine in a direction parallel to the axis of the tubes.

2. The process as in claim 1, comprising separating the randomly loaded tubes into a row of adjacent tubes prior to said transferring.

3. The process as in claim 2, wherein said transferring comprises simultaneously transferring the row of adjacent tubes to the conveyor device.

4. The process as in claim 1, further comprising transferring the tubes to the conveyor device with a slider device.

5. The process as in claim 4, further comprising sliding the tubes with the slider device onto individual tube holders disposed along the conveyor device.

6. The process as in claim 5, further comprising sequentially moving the conveyor device until free tube holders are disposed adjacent the tubes positioned for transfer at the transfer positions.

7. The process as in claim 1, wherein said separating comprises guiding the randomly loaded tubes into compartments defined within the storage magazine.

8. The process as in claim 7, further comprising mechanically moving the compartments so as to prevent formation of tube bridges within the storage magazine.

9. The process as in claim 1, further comprising preventing the randomly loaded tubes above the ordered tubes at the transfer positions from following the ordered tubes to the conveyor device during said transfer thereof.

10. A textile spinning plant machine, said machine comprising a storage magazine having an unobstructed space therein for receipt of randomly disposed tubes loaded therein so that said tubes can settle in a random order adjacent each other; a conveyor device disposed adjacent a transfer position defined at said storage magazine, said conveyor configured for receipt of said tubes from said storage magazine in an ordered alignment; said storage magazine further comprising a plurality of stationary compartments defined therein between said unobstructed space and said transfer position, said compartments configured for guiding said randomly loaded tubes to said transfer position in a predetermined ordered alignment; and a slider device operably disposed between said transfer position and said conveyor device, said slider device engaging the tubes delivered from said transfer position and sliding said delivered tubes axially towards said conveyor device in a direction of movement parallel to the axis of said tubes.

11. The machine as in claim 10, wherein said compartments comprise sides defined as movable rockers.

12. The machine as in claim 11, wherein said movable rockers are movably disposed to be alternately shifted in position across said storage magazine.

13. The machine as in claim 10, wherein said compartments comprise a height to accommodate at least two stacked said tubes.

14. The machine as in claim 10, wherein said storage magazine is disposed within a first vertical plane, and said conveyor device is operably disposed in a second vertical plane which is essentially parallel to said first vertical plane.

15. The machine as in claim 10, wherein said slider is operably disposed below said compartments.

16. The machine as in claim 15, wherein said slider further comprises a support configured for supporting the tubes within said compartments.

17. The machine as in claim 10, wherein said conveyor device comprises a conveyor chain having individual tube holders disposed therealong.

18. The machine as in claim 10, further comprising a separating device operably disposed between said compartments and said transfer position, said separating device configured to guide the tubes from said compartments to said conveyor device.

19. The machine as in claim 18, wherein said separating device comprises pairs of laterally movably holders disposed at each said compartment, each said pair of holders comprising individual holders laterally movable relative each other from a spaced position wherein the tubes can pass therethrough, and a closed position to prevent the tubes from passing therethrough.

* * * * *